US005619184A

United States Patent [19]

Torikoshi et al.

[11] Patent Number: 5,619,184

[45] Date of Patent: Apr. 8, 1997

[54] SYSTEM FOR MONITORING DISASTER PREVENTION

[75] Inventors: Yasuo Torikoshi; Naoki Kosugi, both of Tokyo, Japan

[73] Assignee: Hochiki Corporation, Tokyo, Japan

[21] Appl. No.: 540,185

[22] Filed: Oct. 6, 1995

[30] Foreign Application Priority Data

Oct. 7, 1994 [JP] Japan ..... 6-243595

[51] Int. Cl.[6] ..... G08B 26/00

[52] U.S. Cl. ..... 340/506; 340/505; 340/518; 340/588; 340/825.12

[58] Field of Search ..... 340/506, 505, 340/518, 588, 589, 514, 825.06–825.12

[56] References Cited

U.S. PATENT DOCUMENTS

| | | | |
|---|---|---|---|
| 5,227,763 | 7/1993 | Kikuchi | 340/505 |
| 5,389,914 | 2/1995 | Kikuchi | 340/505 |
| 5,493,271 | 2/1996 | Kobayashi et al. | 340/505 |

FOREIGN PATENT DOCUMENTS

| | | |
|---|---|---|
| 0546401A1 | 11/1992 | European Pat. Off. . |
| 277996 | 3/1990 | Japan . |
| 572635 | 10/1993 | Japan . |

*Primary Examiner*—Donnie L. Crosland
*Attorney, Agent, or Firm*—Sughrue, Mion, Zinn, Macpeak & Seas

[57] ABSTRACT

A fire disaster monitoring system of the present invention has a control unit and a fire sensor. The fire sensor includes a sensor base and a sensor body. The sensor base incorporates a first memory which stores first address information of the first memory. The sensor body incorporates a second memory and a CPU therein. The second memory stores second address information of the sensor body. The CPU includes an address reader, a comparator and an address generator. When the power is turned on, the address reader reads the address information in the first memory, and reads the address information in the second memory. The comparator compares the read pieces of address information with each other. When the comparison result by the comparator indicates agreement, the address generator leaves the address information in the second memory as valid data. On the other hand, when the comparison result indicates disagreement, the address generator writes the address information in the first memory into the second memory.

14 Claims, 8 Drawing Sheets

SYSTEM FOR MONITORING DISASTER PREVENTION

BACKGROUND OF THE INVENTION

1. Field of the Invention

The present invention relates to a disaster prevention system which can perform automatic address setting.

2. Description of the Related Art

A known analog sensor connected to a conventional disaster prevention monitoring system is described in, for example, Examined Japanese Patent Publication (Kokoku) No. Hei. 5-72635.

The analog sensor has a head and a base. The head is provided with a sensor portion, and the base is provided with a transmission processing unit which performs signal transmission and reception between the sensor unit and a control unit. The transmission processing unit has a function of identifying an address position and a successive command signal which are sent from the unit and transmitting them to the sensor unit, and that of transmitting various kinds of information obtained from the sensor unit to the control unit.

When the analog sensor is furnished, an endurance test is conducted on the analog sensor by applying a high voltage to a sensor line under a condition where the head of the sensor is detached. Since the transmission processing unit is disposed in the base, the transmission processing unit may possibly become faulty as a result of the dielectric withstand test.

Another known fire alarm device is described in, for example, Unexamined Japanese Patent Publication (Kokai) No. Hei. 2-77996.

In the fire alarm device, only passive means for defining an address code is disposed in the base so as to prevent the above-mentioned failure in the transmission processing unit from occurring. The fire alarm device can be replaced with another one without causing any risky probability that the address at which the alarm device is installed is changed due to carelessness.

Specifically, in the fire alarm device, the address code is set in the attachment base only by mechanical means. The sensor of the device comprises means for sensing the position of the mechanical coding means, or the presence or absence of the means. When the sensor is inserted into a base, the sensor can read the setting of the mechanical address means and convert it into an equivalent electrical code. In this way, when the sensor is inserted into the base, the address in the base is transferred to the sensor.

In the above-described conventional fire alarm device, even when a number of sensor bodies are detached from a number of respective bases for the purpose of cleaning or the like and the sensor bodies fail to be attached to the original bases after the cleaning, addresses can be set again. However, the setting state of each mechanical address means is read by the sensor, and hence a contact failure easily occurs. This may cause a mistake in reading of addresses. Thus, there arises a problem in that the reliability of address setting is lowered.

SUMMARY OF THE INVENTION

It is an object of the present invention to provide a system for monitoring disaster prevention which use a CPU to automatically set an address so as to enhance the reliability of address setting.

The disaster prevention monitoring system of the present invention comprises a control unit for controlling the disaster prevention monitoring system, and a fire sensor including a sensor base connected to the control unit via a sensor line and a sensor body which is fitted to the sensor base. The sensor base includes a first memory for storing first address information of the sensor base. The sensor body includes a transmission processor which controls data transmission between the control unit and the fire sensor; a fire monitoring unit for monitoring an occurrence of fire; a second memory for storing second address information of the sensor body; an address reader for reading the first address information when a power is turned on, and reading the second address information; a comparator for comparing the read pieces of first and second address information with each other; and an address generator for, when a comparison result by the comparator indicates agreement, leaving the second address information in the second memory as valid data, and for, when the comparison result indicates disagreement, writing the first address information into the second memory.

According to the disaster prevention monitoring system of the invention having the above-described construction, when the power is turned on, the first address information in the first memory disposed in the sensor base is read and also the second address information in the second memory disposed in the sensor body is read. The pieces of the address information are compared with each other. When the comparison result indicates agreement, the second address information in the second memory is left as valid data. When the comparison result indicates disagreement, the first address information in the first memory is written into the second memory. With this construction, even when the sensor body is detached from the sensor base for the purpose of cleaning or the like and the sensor body fails to be attached in a predetermined position after the cleaning, the address can be set automatically again.

Unlike a mechanical contact., a contact failure does not occur, and hence the reliability of address setting can be increased.

BRIEF DESCRIPTION OF THE DRAWINGS

In the accompanying drawings.

DETAILED DESCRIPTION OF THE INVENTION

The detailed description of the present invention will be described referring to the accompanying drawings as follows.

Figure 1:
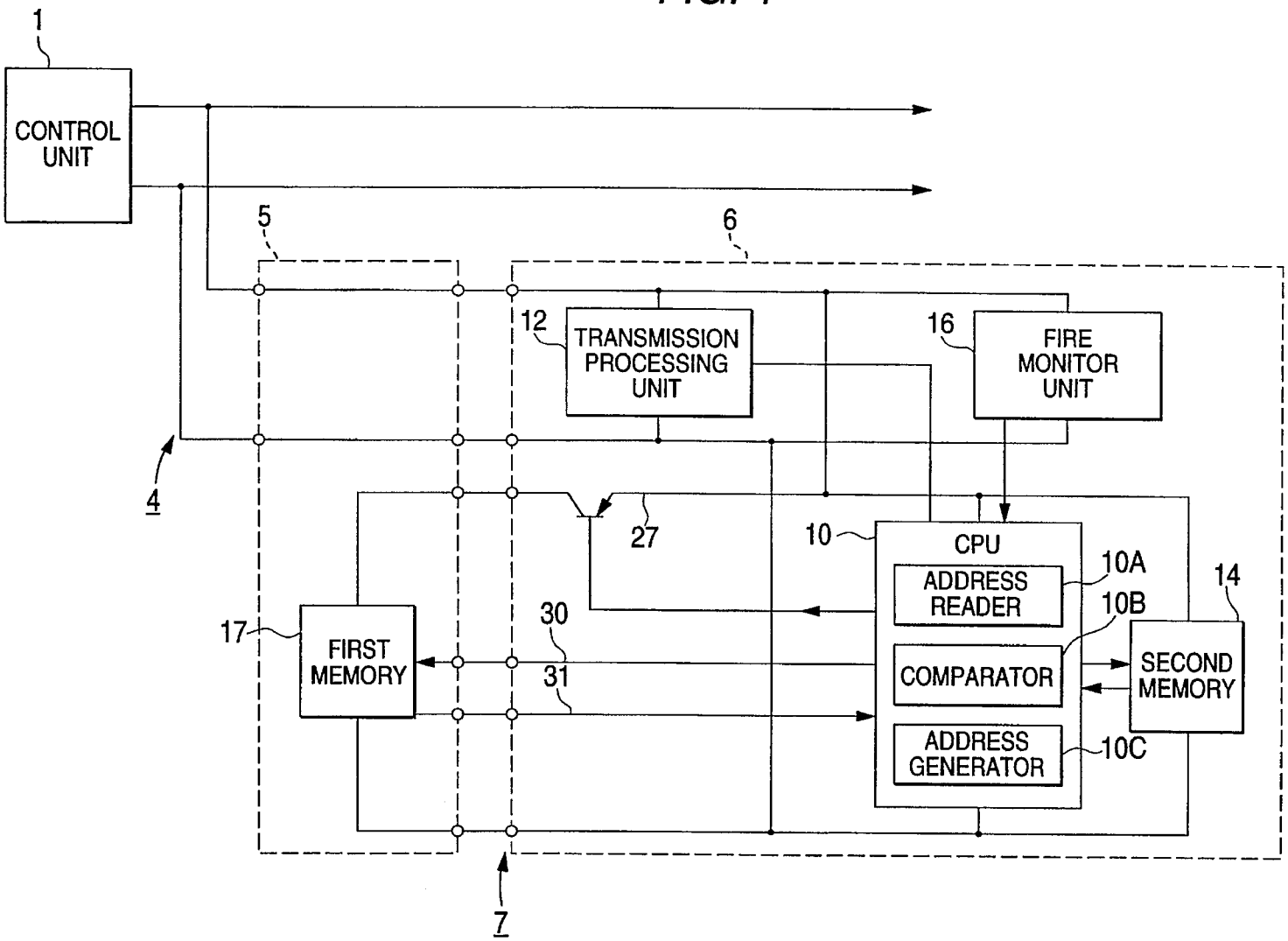
FIG. 1 is a diagram illustrating the principle of the invention.

FIG. 1 is a diagram illustrating the principle of the invention. A disaster prevention monitoring system of the present invention is provided with a control unit 1 and a fire sensor 7. The fire sensor 7 includes a sensor base 5 connected to the control unit 1 via a sensor line 4; and a sensor body 6 which is attached to the sensor base 5, and which incorporates a transmission processing unit 12 and a fire monitoring unit 16. A first memory 17 which stores address information is disposed in the sensor base of the disaster prevention monitoring system. A second memory which stores address information is disposed in the sensor body 6. An address reader 10A, a comparator 10B and an address generator 10C is disposed in a CPU of the sensor body 6. When a power is turned on, the address reader 10A reads the address information in the first memory 17 as well as reads the address information in the second memory 14. The comparator 10B compares pieces of thus read address information with each other. When the comparison result indicates agreement, the address generator 10C leaves the address information in the second memory 14 as valid data. When the comparison result indicates disagreement, the address generator 10C writes the address information in the first memory 17 into the second memory 14.

Also, in the present invention, the monitoring system further includes a power supply line 27, a synchronizing signal line 30 and a data signal line 31. The power supply line 27 is independently provided between the first memory 17 so that an electric power is supplied from the CPU 10 to the first memory 17. The synchronizing signal line 30 sends an address clock signal from the CPU 10 to the first memory 17. The data signal line 31 sends data from the first memory 17 to the CPU 10 in synchronization with the address clock signal.

Further, in the present invention, a control unit 1 includes instruction unit, comparator and a display. The instruction unit instructs the CPU 10 to transmit the address information in the first memory 17 and the address information in the second memory 14 to the control unit 1. The comparator compares pieces of transmitted address information with each other. The display displays a comparison result in the comparator.

Hereinafter, embodiments of the invention will be described with reference to the accompanying drawings.

Figure 2:
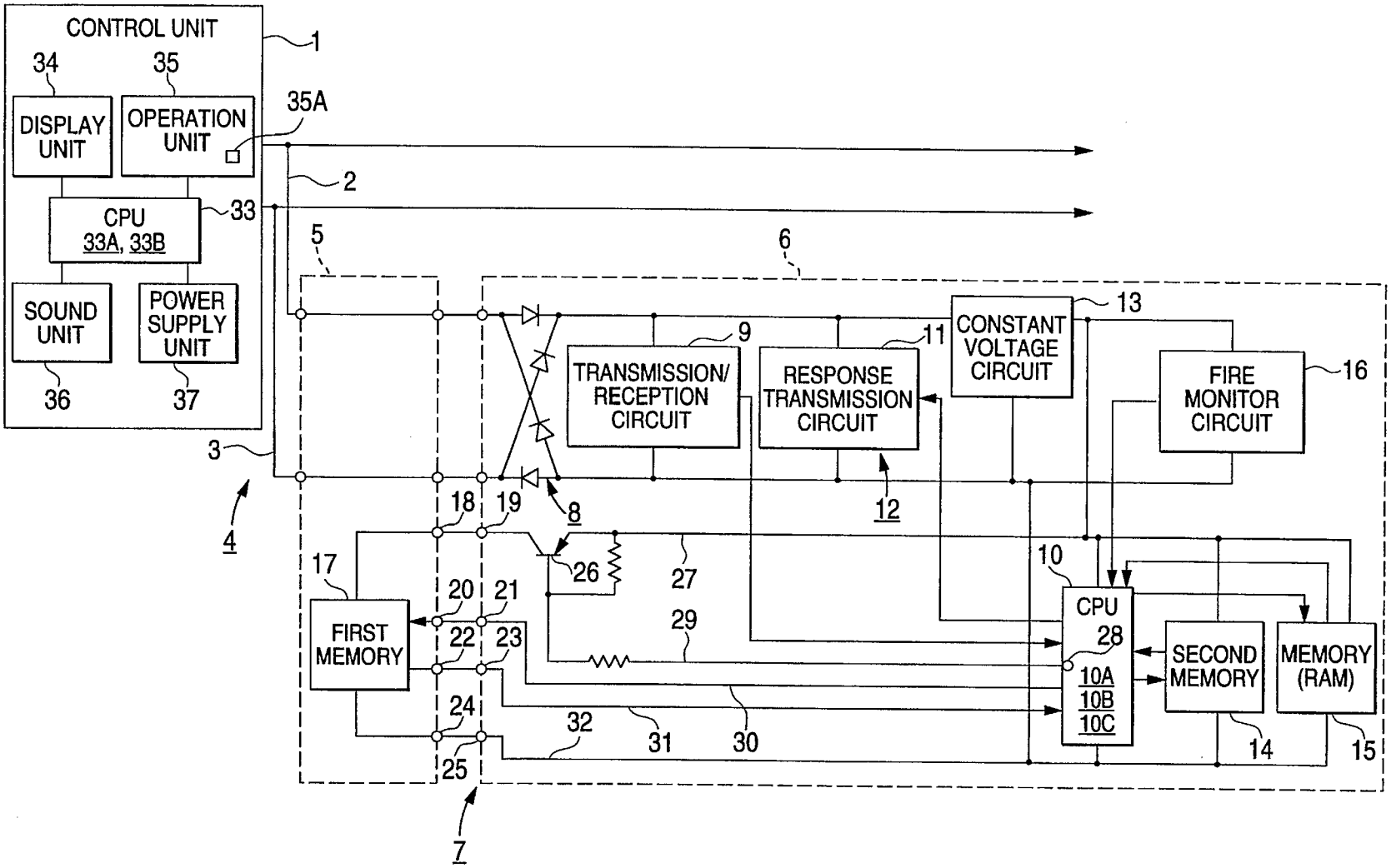
FIG. 2 is a diagram showing the entire construction of a first embodiment of the invention.
Figure 3:
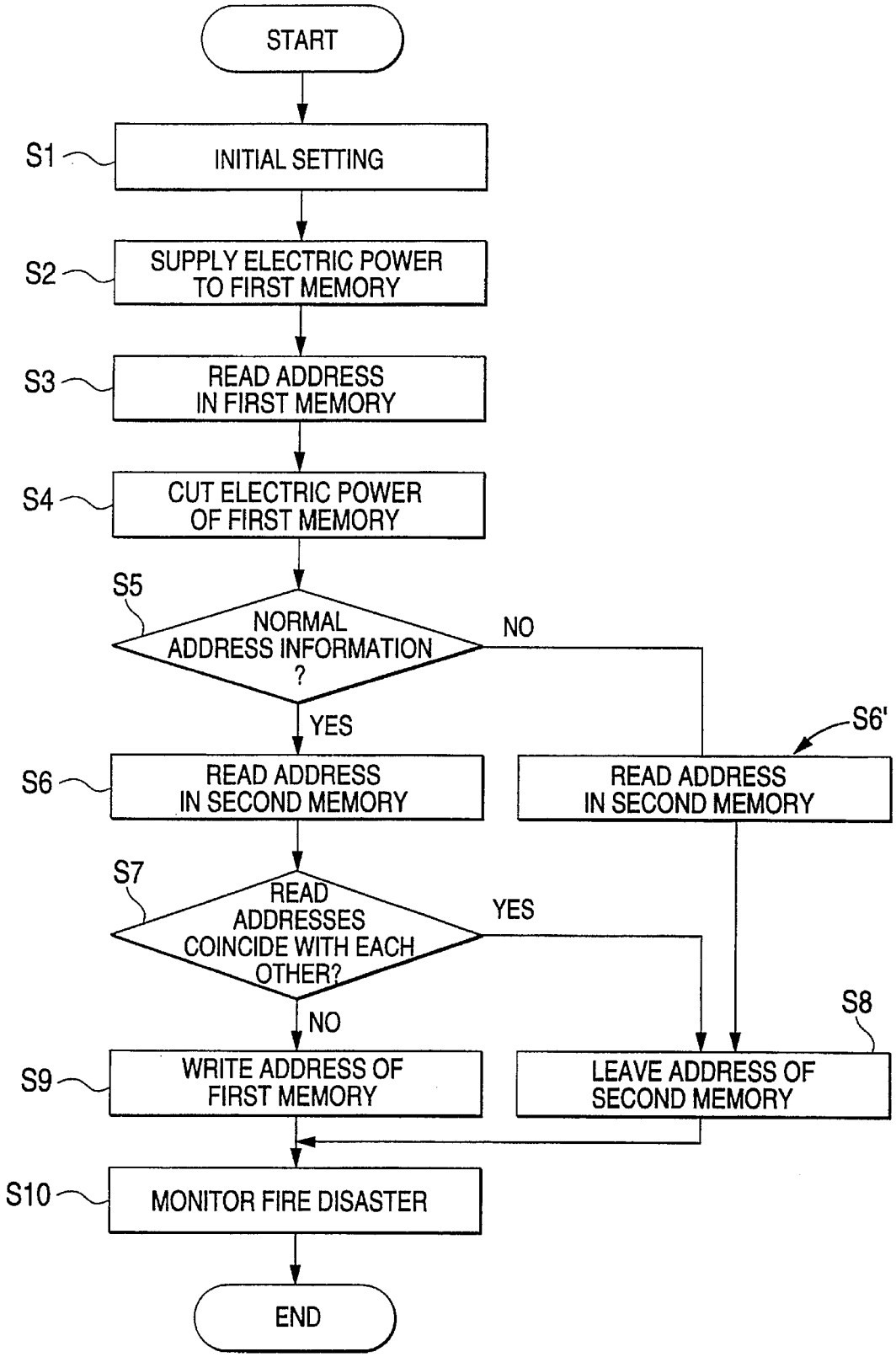
FIG. 3 is a flowchart illustrating the operation of the first embodiment.

FIGS. 2 to 4 are diagrams showing a first embodiment of the invention. FIG. 2 is a diagram showing the entire construction of the first embodiment of the invention.

In FIG. 2, a sensor line 4 including a power supply/signal line 2 and a common line 3 is led from a control unit 1. A plurality of fire sensors 7 each having a sensor base 5 and a sensor body 6 are connected to the sensor line 4. A sensor body 6 is fitted to a sensor base 5.

A rectifying circuit 8 is disposed in the sensor base 5. The rectifying circuit 8 is used for non-polarizing the connection polarity of the power supply.

The rectifying circuit 8 is followed by a transmission reception circuit 9. The transmission/ reception circuit 9 detects a call signal in a voltage mode from the control unit 1, and transmits it to a CPU 10 functioning as the controller. The transmission reception circuit 9 is followed by a response transmission circuit 11. The response transmission circuit 11 returns a response signal from the CPU 10 to the control unit 1.

The transmission reception circuit 9 and the response transmission circuit 11 constitute a transmission processing unit 12 as a whole.

The response transmission circuit 11 is followed by a constant voltage circuit 13. The constant voltage circuit 13 receives a constant voltage of, for example, 24 V from the control unit 1 and converts it into a constant voltage of 5 V so as to supply the constant voltage as an electric power to the CPU 10, memories 14 and 15, and a fire monitor circuit 16 functioning as the fire monitoring unit.

The fire monitor circuit 16 performs the fire monitoring, and outputs a detection signal to the CPU 10. The CPU 10 conducts the A/D conversion on the detection signal, and then stores the resulting digital signal in the memory 15 which is a RAM.

The second memory 14 is a nonvolatile memory (EEPROM) into and from which data can be written and erased. Initial information is stored in the second memory 14. The initial information includes a production number set in a factory, an arbitrary number which is set by an address setting jig in the production or in the installation, type information, and the like. All of the initial information or one of them, for example, the production number is utilized as the address information.

Alternatively, a part of the production number may be used as the address information. Accordingly, the second memory 14 stores address information.

In the case where the transmission reception circuit 9 detects a call signal due to normal polling, when the address information stored in the second memory 14 agrees with the call signal, the CPU 10 returns the detection data stored in the memory (RAM) 15 from the response transmission circuit 11 to the control unit 1. When the command from the control unit 1 is a sampling command, the CPU 10 reads the detection signal of the fire monitor circuit 16, converts the signal into a digital signal, and stores the digital signal in the memory (RAM) 15. Then, the CPU 10 checks the stored detection data as to whether there exists data of fire detection processing or not. If there exists the data of fire detection processing in the stored detection data, a fire detection signal is transmitted as a response signal from the response transmission circuit 11 to the control unit 1.

The reference numeral 17 designates a memory disposed in the sensor base 5. The first memory 17 is a nonvolatile memory (EEPROM) into and from which data can be written and erased. The first memory 17 is detachably attached on the sensor base 5. Accordingly, it is unnecessary to prepare various types of sensors depending on the user requirements, and it is sufficient to produce one type. The first memory 17 stores address information as similar to data stored in the second memory 14.

The first memory 17 and the CPU 10 are connected to each other by means of a power supply line 27 via terminals 18, 19 and a transistor 26. The base of the transistor 26 is connected to an output port 28 of the CPU 10 via a control line 29.

When the output at the output port 28 of the CPU 10 is set to be "low" level, the transistor 26 is turned on so that a constant electric power is supplied from the constant voltage circuit 13 to the first memory 17 via the power supply line 27.

The first memory 17 and the CPU 10 are also connected to each other by means of a synchronizing signal line 30 via terminals 20 and 21. The CPU 10 outputs a read command and a clock signal which indicates a memory address to be read, to the first memory 17 via the synchronizing signal line 30.

The first memory 17 and the CPU 10 are connected to each other also by means of a data signal line 31 via terminals 22 and 23. The first memory 17 returns specified address information in synchronization with the clock signal to the CPU 10. The first memory 17 and the CPU 10 are connected to each other by means of a ground line 32 via terminals 24 and 25.

As described above, the first memory 17 and the CPU 10 are connected to each other by means of the power supply line 27, the synchronizing signal line 30, the data signal line 31, and the ground line 32, independently of the sensor line 4. For this reason, a high voltage which is applied during an insulation test for the sensor line 4 is not applied to the first memory 17, so that the first memory 17 will not be broken. The insulation test for the sensor line 4 is conducted in a condition where the sensor body 6 is detached from the sensor base 5.

Then the sensor body 6 is fitted to the sensor base 5. The power is turned on so that the CPU 10 starts its operation. Specifically, the CPU 10 has functions of a address reader 10A for reading the address information from the first memory 17 of the sensor base 5 as well as the address information from the second memory 14 of the sensor body 6, the comparator 10B for comparing pieces of the read address information with each other, and the address generator 10C for, when the comparison result indicates agreement, leaving the address information in the second memory 14 as valid data, and for, when the comparison result indicates disagreement, writing the address information in the first memory 17 into the second memory 14. In this way, the automatic address setting is performed.

On the other hand, the control unit 1 has a CPU 33. A display unit 34, an operation unit 35, a sound unit 36 outputting an alarm and a voice message, and a power supply unit 37 are connected to the CPU 33.

The CPU 33 has functions of instruction unit 33A for instructing the CPU 10 of the sensor body 6 to transmit the address information in the second memory 14 and the address information in the first memory 17 to the control unit 1, and comparator 33B for comparing the pieces of address information transmitted from the sensor body 6 with each other.

The operation unit 35 is provided with a switch 35A for instructing the transmission of the pieces of address information. The instruction unit 33A is activated by the on operation of the switch 35A. The display unit 34 displays the comparison result obtained from the comparator 33B. If the comparison result indicates that they do not coincide with each other, or if the pieces of address information are not transmitted, it is judged that a failure occurs in the second memory 14 or the first memory 17.

In this way, after the address is automatically set, the pieces of address information are checked as to whether they coincide with each other or not. If they do not coincide with each other, it is possible to detect a failure of the memory 14 or 17.

Next, the operation will be described. FIG. 3 is a flowchart illustrating the operation of the CPU 10 disposed in the sensor body 6. FIGS. 4A to 4D are diagrams showing the transmission and reception of signals between the first memory 17 of the sensor base 5 and the CPU 10.

First, referring to FIG. 3, when the sensor body 6 is fitted to the sensor base 5, an electric power is supplied from the control unit 1 to the sensor body 6. After an elapse of a delay time of several seconds, an initial setting of the CPU 10 is performed in step S1.

Figures 4A, 4B, 4C, 4D:
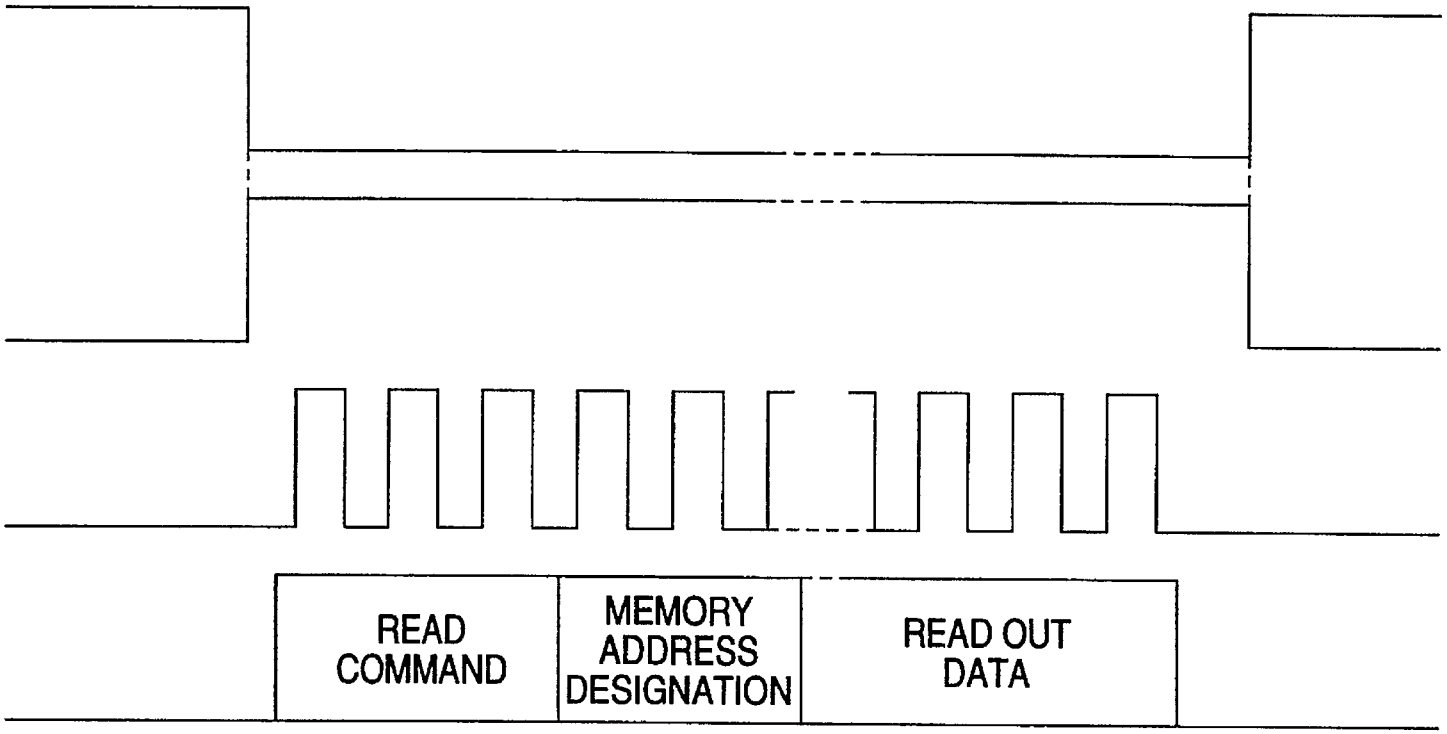
FIGS. 4A to 4D are diagrams illustrating the transmission and reception of data.

Next, in step S2, the CPU 10 supplies the electric power to the first memory 17 of the sensor base 5. That is, as shown in FIG. 4A, when the output at the output port 28 of the CPU 10 is set to be "low" level, the transistor 26 is turned on. As a result, the electric power is supplied from the power supply line 27 to the first memory 17 as shown in FIG. 4B.

Next, the address information in the first memory 17 of the sensor base 5 is read out in step S3. Accordingly, as shown in FIG. 4C, a clock is sent from the CPU 10, and, in synchronization with this clock, the CPU 10 sends a read command and a clock signal which indicates a memory address to be read out, to the first memory 17 via a synchronizing signal line 30. The first memory 17 returns the contents of the specified memory address as a read out data, i.e., the address information to the CPU 10 via the data signal line 31 in synchronization with the clock signal. (FIG. 4D)

When the reading of the address information in the first memory 17 of the sensor base 5 is finished, the output at the output port 28 of the CPU 10 is set to be "high" level in step S4. As a result, the transistor 26 is turned off so that the power supply to the first memory 17 is cut off.

Next, the CPU 10 judges in step S5 as to whether the address information read out from the first memory 17 is normal address information or abnormal. If any read error occurs, the process proceeds to step S6', and, if no read error occurs, the process proceeds to step S6. Specifically, it is assumed that the address information previously determined in this system is in the range of 1 to 127. When the address information read out from the first memory 17 is within the range, this address information is normal. When the address information read out from the first memory 17 is out of the range, for example, 0, 250 or the like, this address information is abnormal.

In step S6, the address information in the second memory 14 of the sensor body 6 is read out. In step S7, the read out address information is compared with the address information in the first memory 17 of the sensor base 5. Also, in step S6', the process similar to the step S6 is performed. However, after step S6', since the address information read out in step S3 is not normal, the process is proceeded directly to step S8.

When the pieces of the read out address information coincide with each other, the process proceeds to step S8, and the address information in the second memory 14 of the sensor body 6 is left as valid data. If the pieces of address information do not coincide with each other, the process proceeds to step S9, and the address information in the first memory 17 of the sensor base 5 is written into the second memory 14 of the sensor body 6.

As a result, the address information in the first memory 17 of the sensor base 5 is made coincide with the address information in the second memory 14 of the sensor body 6.

When the pieces of the read out address information coincide with each other, the process proceeds to step S10, the fire monitoring is performed. When a call signal from the control unit 1 is detected by the transmission reception circuit 9, the signal is fed to the CPU 10. The CPU 10 checks as to whether or not the call address coincides with the address information in the second memory 14. If they coincide with each other, the detection data stored in the memory (RAM) 15 is transmitted from the response transmission circuit 11 to the control unit 1 in normal polling. When a sampling command is received, the detection result of the fire monitor circuit 16 is read out, and the read out result is subjected to the A/D conversion. Thereafter, the resulting digital data are stored in the memory (RAM) 15. The stored detection data are checked as to whether or not there exists data in a fire detection region. If there exists such data, a fire detection signal is transmitted from the response transmission circuit 11 to the control unit 1.

As described above, even when a number of sensor bodies 6 are detached from a number of respective sensor bases 5 for the purpose of cleaning or the like and the sensor bodies 6 fail to be attached to the sensor bases 5 in a predetermined manner after the cleaning, the addresses can be set automatically again. Since the memories 14 and 17 are EEPROMs, there is no possibility that a contact failure occurs unlike a mechanical contact. Thus, the reliability of address setting can be increased.

The first memory 17 is disposed independently of the sensor line 4. Even when an insulation test for the sensor line 4 is performed from the sensor base 5 in a condition where the sensor body 6 is detached, therefore, the first memory 17 will not be broken.

In addition, the first memory 17 is detachably attached to the sensor base 5, so that it is unnecessary to increase the number of sensor types. That is, it is sufficient to produce only one type.

Figure 5:
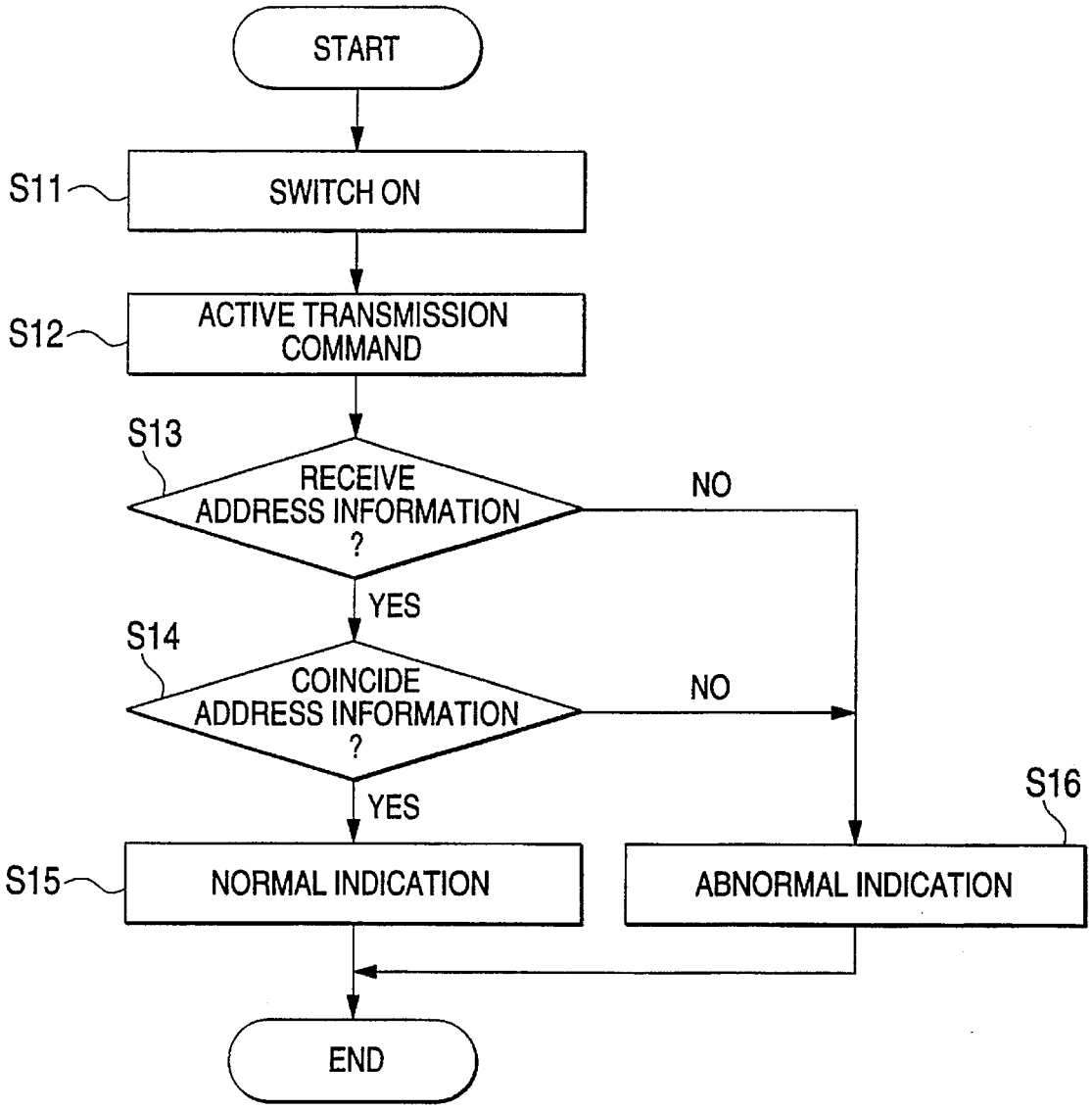
FIG. 5 is a flowchart illustrating the operation of the control unit.

Next, FIG. 5 is a flowchart illustrating the operation of the control unit 1. Referring to FIG. 5, when the operation of fitting the sensor body 6 to the sensor base 5 is completed, the switch 35A of the operation unit 35 is first turned on in step S11 in order to determine whether the addresses coincide with each other or not.

Then the instruction unit 33A of the CPU 33 is activated in step S12 so as to instruct the CPU 10 of the sensor body 6 to transmit the address information in the second memory 14 and the address information in the first memory 17 to the control unit 1.

Next, it is determined in step S13 as to whether or not the pieces of the address information are received from the memories 14 and 17. If the pieces of the address information are not received, it is judged that a failure occurs in the memory 14 or 17, and an abnormality indication is displayed on the display unit 34 in step S16.

If the pieces of the address information are properly received, the process proceeds to step S14 in which the address information is checked to judge as to whether or not they coincide with each other. If they do not coincide with each other, it is judged that a failure occurs in the memory 14 or 17, and an abnormality indication is displayed on the display unit 34 in step S16. If the pieces of information coincide with each other, a normal indication is displayed on the display unit 34 in step S15. As described above, in the embodiment, the control unit 1 can determine whether the address information in the memory 14 coincides with the address information in the first memory 17 or not. If the information do not coincide with each other, it is possible to detect that a failure occurs in the memory 14 or 17.

Figure 6:
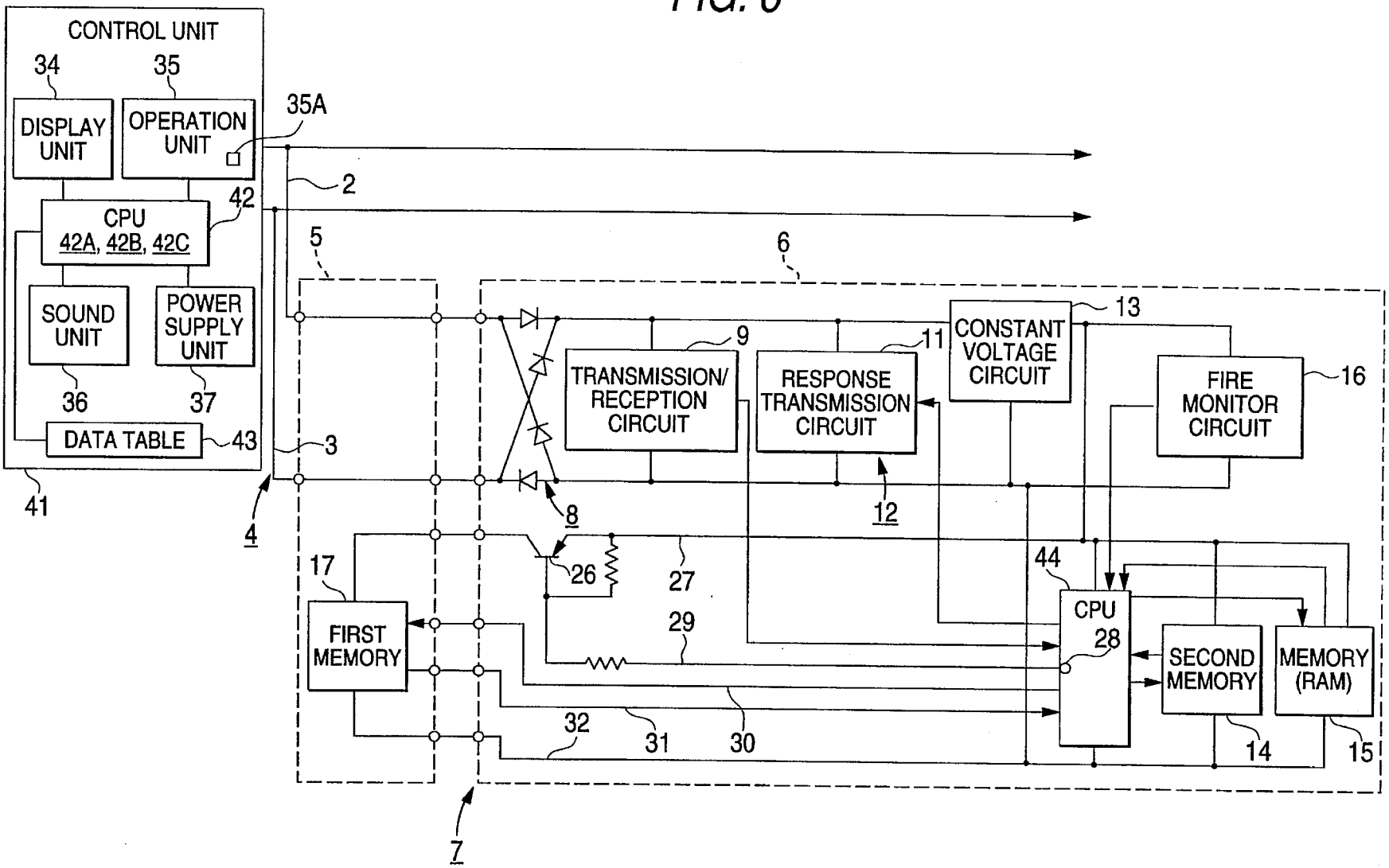
FIG. 6 is a diagram showing the entire construction of a second embodiment of the invention.

Next, FIG. 6 is a diagram showing a second embodiment of the invention.

In the embodiment, the automatic address setting is performed in a control unit 41.

In FIG. 6, 42 designates a CPU disposed in the control unit 41. A data table 43 which previously stores address information, a display unit 34, an operation unit 35, a sound unit 36 outputting an alarm and a voice message, and a power supply unit 37 are connected to the CPU 42.

The data table 43 previously stores the address information stored in the first memory 17 of the sensor base 5 and that stored in the second memory 14 of the sensor body 6.

The CPU 42 has functions of transmission instruction unit 42A for instructing a CPU 44 of the sensor body 6 to transmit the address information in the second memory 14 and the address information in the first memory 17 to the control unit 41, comparator 42B for comparing the respective transmitted pieces of address information with the address information in the data table 43, and address generation instruction unit 42C for, when the comparison result indicates agreement, instructing the CPU 44 to leave the address information in the second memory 14 as valid data, and for, when the comparison result indicates disagreement, instructing the CPU 44 to write the address information in the first memory 17 into the second memory 14.

When the CPU 44 of the sensor body 6 receives the transmission command, it reads out the pieces of address information from the memories 14 and 17 to return them to the control unit 41. When the CPU 44 receives the address generation command, it writes the address information in the first memory 17 into the second memory 14.

On the other hand, when no answer of address information is fed to the control unit 41, the CPU 42 of the control unit 41 judges that the address information disappear because of a failure of the memory 14 and/or 17, and controls the display unit 34 so as to display an abnormality indication thereon. The operation unit 35 is provided with a switch 35A for activating the transmission command.

Figure 7:
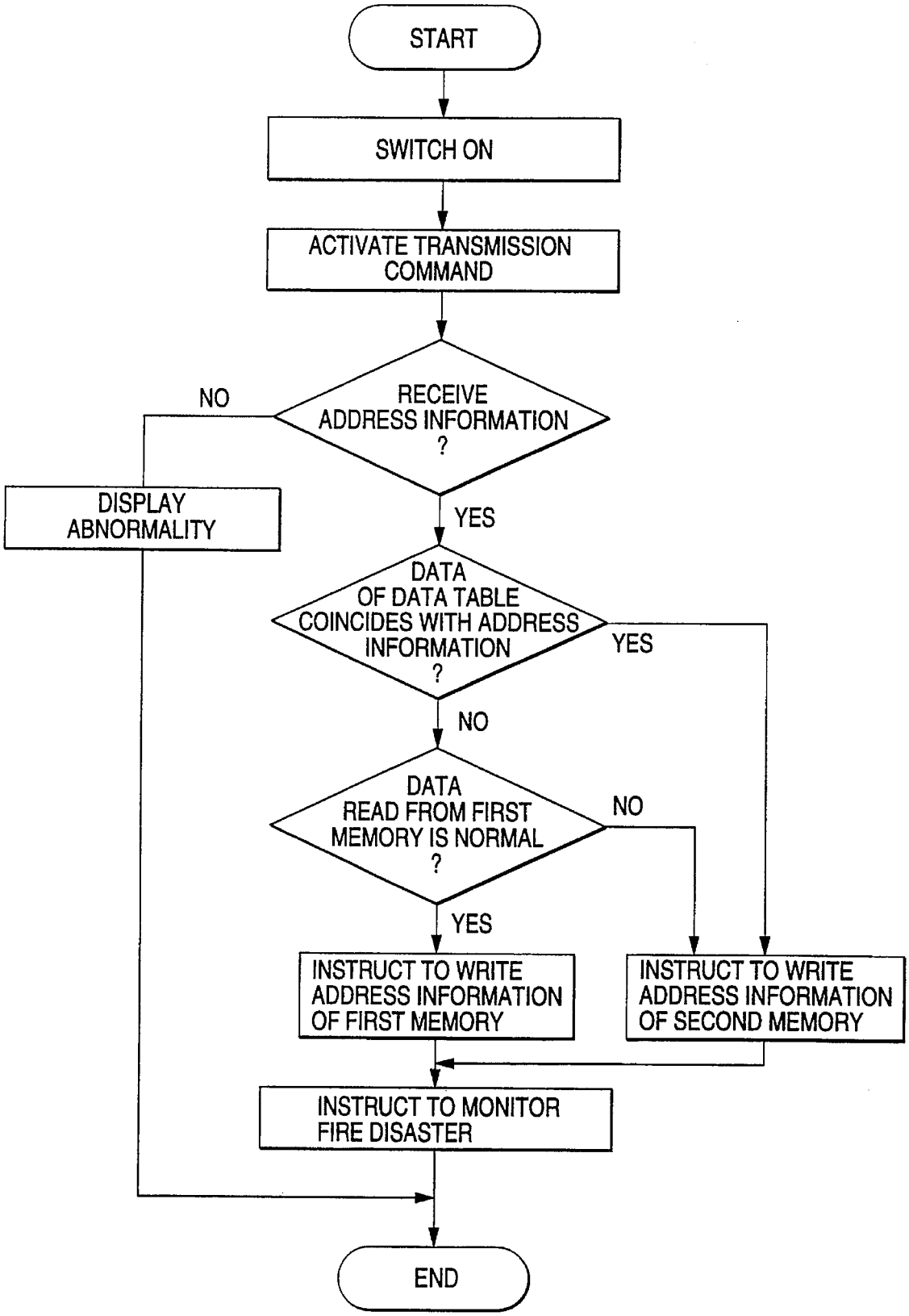
FIG. 7 is a flowchart illustrating the operation of the second embodiment.

Next, FIG. 7 is a flowchart illustrating the operation of the control unit 41.

Referring to FIG. 7, when the operation of fitting the sensor body 6 to the sensor base 5 is completed, the switch 35A of the operation unit 35 in the control unit 41 is turned on in step S21. When the switch 35A is turned on, the transmission command unit 42A of the CPU 42 is activated in step S22. As a result, the CPU 44 of the sensor body 6 is instructed to transmit the address information in the second memory 14 and the address information in the first memory 17 to the control unit 41.

Then the CPU 42 judges as to whether or not the pieces of address information in the memories 14 and 17 are received in step S23 from the CPU 44 of the sensor body 6. If the address information is received, the process proceeds to step S25. If the pieces of address information are not received, the process proceeds to step S24 in which it is judged that a failure occurs in the memory 14 and/or 17 and the address information disappear. As a result, an abnormality is indicated on the display unit 34.

Next, the respective received address information are compared in step S25 with the corresponding pieces of address information which are previously stored in the data table 43. When the pieces of address information coincide with each other, the CPU 44 is instructed in step S27 to leave the address information in the second memory 14 of the sensor body 6 as valid data.

If the pieces of address information do not coincide with each other, it is judged as to whether or not the address information in the first memory 17 of the sensor base 5 is normal information. If the address information in the first memory 17 is normal information, the process proceeds to the step S28 so that the CPU 44 is instructed in step S28 to write the address information in the first memory 17 of the sensor base 5 into the second memory 14. On the other hand, if the address information in the first memory 17 is not normal information, the process proceeds to the step S27 so that the CPU 44 is instructed to leave the address information in the second memory 14 of the sensor body 6 as valid data.

Thereafter, the fire monitoring command is output to the fire sensor 7 in step S29.

In the embodiment, the same effects as those in the above-described embodiment can be attained, and additionally the automatic address setting can be performed in the control unit 41.

Figure 8:
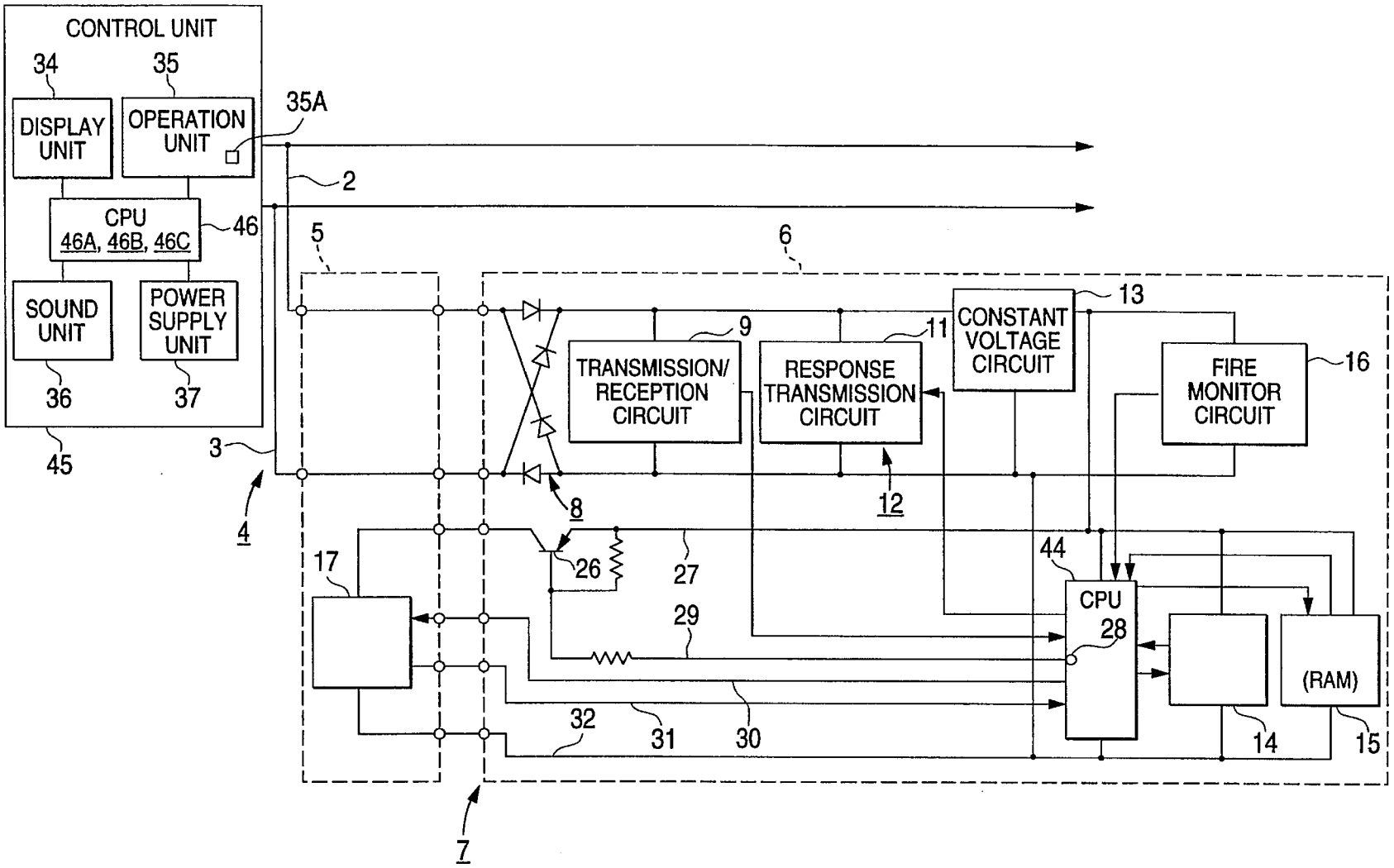
FIG. 8 is a diagram showing the entire construction of a third embodiment of the invention.

Next, FIG. 8 is a diagram showing a third embodiment of the present invention.

Also in the embodiment, the automatic address setting is performed in the control unit 41.

In FIG. 8, reference numeral 46 designates a CPU disposed in a control unit 45. A display unit 34, an operation unit 35, a sound unit 36 for outputting an alarm and a voice message, and a power supply unit 37 are connected to the CPU 46.

The CPU 46 has a transmission instruction unit 46A for instructing the CPU 44 of the sensor body 6 to transmit the address information in the second memory 14 and the address information in the first memory 17 to the control unit 45, comparator 46B for comparing the transmitted pieces of address information with each other, and address generation instruction unit 46C for, when the comparison result indicates agreement, instructing the CPU 44 to leave the address information in the second memory 14 as valid data, and for, when the comparison result indicates disagreement, instructing the CPU 44 to write the address information in the first memory 17 into the second memory 14.

When the transmission command is received, the CPU 44 of the sensor body 6 reads the pieces of address information in the memories 14 and 17, and returns them to the control unit 45. When the address generation command is received, the CPU 44 writes the address information in the first memory 17 into the second memory 14.

On the other hand, when no answer of the pieces of address information is fed to the control unit 41, the CPU 46 of the Control unit 45 judges that the pieces of address information disappear because of a failure of the second memory 14 or 17, and controls the display unit 34 so as to display an abnormality indication thereon. The operation unit 35 is provided with a switch 35A for activating the transmission command. In addition, also in this embodiment, the address information transmitted from the first memory 17 is abnormal, the CPU 46 is instructed to leave the address information in the second memory 14 of the sensor body 6 as valid data.

The operation of the embodiment is the same as that of the above-described embodiment except for the contents of step S25.

In the above-described embodiment, in step S25, each pieces of address information in the data table 43 is compared with a corresponding one of the received pieces of address information. In the present embodiment, the received pieces of address information are compared with each other. When the comparison result indicates agreement, the address information in the second memory 14 of the sensor body 6 is left as valid data. If the comparison result indicates disagreement, it is instructed that the address information in the first memory 17 of the sensor base 5 is written into the second memory 14 of the sensor body 6. In this way, the automatic address setting is performed. In the embodiment, the data table 43 is not required, but the same effects as those in the above-descried embodiment can be attained.

As described above, according to the invention, even when a sensor body is detached from a sensor base for the purpose of cleaning or the like and the sensor body fails to be attached in a predetermined position after the cleaning, the automatic address setting can be performed.

Unlike in a mechanical contact, a contact failure does nor occur, and hence the reliability of the address setting can be increased.

In addition, even when an insulation test for the sensor line is performed in a condition where the sensor body is detached, the first storing means disposed in the sensor base will not be broken.

Since the first storing means is detachably attached to the sensor base, it is unnecessary to increase the number of sensor types.

In addition, the control unit can determine whether the address information in the first storing means coincides with the address information in the second storing means or not. If they do not coincide with each other, it is possible to detect a failure in the first or second storing means.

In addition, in the other embodiments, the automatic address setting can be performed in the control unit.

What is claimed is:

1. A disaster prevention monitoring system comprising a control unit for controlling said disaster prevention monitoring system, and a fire sensor including a sensor base connected to said control unit via a sensor line and a sensor body which is fitted to said sensor base;

said sensor base including:

first storing means for storing first address information of said sensor base;

said sensor body including:

a transmission processing unit which controls data transmission between said control unit and said fire sensor;

a fire monitoring unit for monitoring an occurrence of fire;

second storing means for storing second address information of said sensor body;

reading means for reading the first address information in said first storing means when a power is turned on, and reading the second address information in said second storing means;

comparing means for comparing the read pieces of first and second address information with each other; and address generating means for, when a comparison result by said comparing means indicates agreement, leaving the second address information as valid data, and for, when the comparison result indicates disagreement, writing the first address information into said second storing means.

2. A disaster prevention monitoring system according to claim 1, further comprising:

a power supply line for supplying an electric power from said control means to said first storing means, said power supply line being provided between said first storing means and said control means and independently of said sensor line;

an synchronizing signal line for sending an address clock signal from said control means to said first storing means; and a data signal line for sending data from said first storing means to said control means in synchronization with said address clock signal.

3. A disaster prevention monitoring system according to claim 1, wherein said control unit including:

instruction means for instructing said control means to transmit the address information in said first storing means and the address information in said second storing means of said fire sensor, to said control unit;

comparing means for comparing the transmitted pieces of address information with each other; and display means for displaying a comparison result in said comparing means.

4. A disaster prevention monitoring system according to claim 2, wherein said control unit including:

instruction means for instructing said control means to transmit the address information in said first storing means and the address information in said second storing means of said fire sensor, to said control unit;

comparing means for comparing the transmitted pieces of address information with each other; and display means for displaying a comparison result in said comparing means.

5. A disaster prevention monitoring system according to claim 1, wherein, when the first address information read from said first storing means is abnormal, said address generating means leaves the second address information as valid data.

6. A disaster prevention monitoring system according to claim 1, wherein said first storing means is detachably attached to said sensor base.

7. A disaster prevention monitoring system comprising a control unit for controlling said disaster prevention monitoring system, and a fire sensor including a sensor base connected to said control unit via a sensor line and a sensor body which is fitted to said sensor base;

said sensor base including:

first storing means for storing first address information of said sensor base;

said sensor body including:

a transmission processing unit which controls data transmission between said control unit and said fire sensor;

a fire monitoring unit for monitoring an occurrence of fire;

second storing means for storing second address information of said sensor body; and control means for controlling said first storing means and said second control means;

said control unit including:

a data table which previously stores address information to be stored in said first storing means and address information to be stored in said second storing means;

transmission instruction means for instructing said control means to transmit the first and second address information to said control unit;

comparing means for comparing the transmitted pieces of the first and second address information with the pieces of address information in said data table, and address generation instruction means for, when a comparison result indicates agreement, instructing said control means to leave the second address information, and for, when the comparison result indicates disagreement, instructing said control means to write the first address information into said second storing means.

8. A disaster prevention monitoring system according to claim 7, wherein said control unit further includes display means for displaying an abnormality indication in a case where there is no answer when said transmission instruction means instructs said control means to transmit the first and second address information.

9. A disaster prevention monitoring system according to claim 7, wherein, when the first address information read from said first storing means is abnormal, said address generating means leaves the second address information as valid data.

10. A disaster prevention monitoring system according to claim 7, wherein said first storing means is detachably attached to said sensor base.

11. A disaster prevention monitoring system comprising a control unit for controlling said disaster prevention monitoring system, and a fire sensor including a sensor base connected to said control unit via a sensor line and a sensor body which is fitted to said sensor base;

said sensor base including:

first storing means for storing first address information of said sensor base;

said sensor body including:

a transmission processing unit which controls data transmission between said control unit and said fire sensor;

a fire monitoring unit for monitoring an occurrence of fire;

second storing means for storing second address information of said sensor body; and control means for controlling said first storing means and said second control means;

said control unit including:

transmission instruction means for instructing said control means to transmit the first and second address information to said control unit;

comparing means for comparing the transmitted pieces of address information with each other; and address generation instruction means for, when a comparison result indicates agreement, instructing said control means to leave the second address information, and for, when the comparison result indicates disagreement, instructing said control means to write the first address information to said first storing means.

12. A disaster prevention monitoring system according to claim 11, wherein said control unit further includes display means for displaying an abnormality indication in a case where there is no answer when said transmission instruction means instructs said control means to transmit the first and second address information.

13. A disaster prevention monitoring system according to claim 11, wherein, when the first address information read from said first storing means is abnormal, said address generating means leaves the second address information as valid data.

14. A disaster prevention monitoring system according to claim 11, wherein said first storing means is detachably attached to said sensor base.

* * * * *